US005845826A

United States Patent [19]

Nguyen

[11] Patent Number: 5,845,826

[45] Date of Patent: Dec. 8, 1998

[54] ARM POUCH ACCESORY AND THE METHOD FOR USING SAME FOR THE DELIVERY OF MAIL

[76] Inventor: Hue Van Nguyen, 10510 Ferguson Rd., Dallas, Tex. 75228

[21] Appl. No.: 757,144

[22] Filed: Nov. 27, 1996

[51] Int. Cl.[6] ..... A45F 5/00

[52] U.S. Cl. ..... 224/222; 224/219; 224/236; 224/267

[58] Field of Search ..... 224/219, 220, 224/221, 222, 223, 191, 655, 625, 661, 235, 236, 237, 911, 267

[56] References Cited

U.S. PATENT DOCUMENTS

| | | | |
|---|---|---|---|
| D. 214,560 | 7/1969 | Kassel | 224/911 |
| D. 294,198 | 2/1988 | Collins | 224/911 |
| 1,287,875 | 12/1918 | Careless | 224/222 |
| 2,396,118 | 3/1946 | Ohlemeyer | 224/911 |
| 2,553,317 | 5/1951 | Hill | 224/221 |
| 2,813,602 | 11/1957 | MacArthur, Jr. . | |
| 2,881,441 | 4/1959 | Bass . | |
| 4,184,528 | 1/1980 | Kobilan | 224/219 |
| 4,260,089 | 4/1981 | Dalco | 224/911 |
| 4,262,832 | 4/1981 | Perkins | 224/911 |
| 4,432,477 | 2/1984 | Haidt et al. | 224/267 |
| 4,804,122 | 2/1989 | Knox | 224/220 |
| 4,836,428 | 6/1989 | Evans . | |
| 4,848,624 | 7/1989 | Clem | 224/661 |
| 4,881,671 | 11/1989 | Horton et al. | 224/222 |
| 4,905,881 | 3/1990 | Graber | 224/267 |
| 5,088,634 | 2/1992 | MacLaren . | |
| 5,170,917 | 12/1992 | Tourigny | 224/219 |
| 5,215,238 | 6/1993 | Baruch | 224/911 |
| 5,294,030 | 3/1994 | Jollivette . | |
| 5,445,303 | 8/1995 | Cawile, Jr. | 224/661 |
| 5,472,125 | 12/1995 | Barnard | 224/219 |
| 5,586,701 | 12/1996 | Kim | 224/236 |

FOREIGN PATENT DOCUMENTS

| | | | |
|---|---|---|---|
| 110611 | 10/1917 | United Kingdom | 224/221 |

*Primary Examiner*—Allan N. Shoap
*Assistant Examiner*—Gregory M. Vidovich
*Attorney, Agent, or Firm*—William D. Jackson; Locke Purnell Rain Harrell

[57] ABSTRACT

An arm pouch accessory or support structure adapted to be worn by a mail carrier to assist in the carrying, sorting, and delivery of incoming and outgoing mail, as well as the method or process of using this accessory. The arm pouch facilitates the exchange of incoming and outgoing mail by providing an easily accessible, convenient, and partitioned transition area between the mail carrier's mailbag and a mailbox.

17 Claims, 1 Drawing Sheet

ARM POUCH ACCESORY AND THE METHOD FOR USING SAME FOR THE DELIVERY OF MAIL

FIELD OF THE INVENTION

The present invention relates to accessories or support structures, and more particularly to arm support structures, for use by mail carriers in the delivery of mail, as well as the method and process for using such accessories or support structures.

BACKGROUND OF THE INVENTION

In the delivery of mail it is conventional practice for mail carriers to use large satchel-type mailbags to carry, deliver, and sort mail. Such mailbags are typically slung over the mail carrier's shoulder when walking their routes. Where vehicles are used to deliver mail to curb-mounted mail boxes, satchels of this type may be employed, usually resting on the seat of the delivery vehicle, or another container may be used to carry the mail.

Various devices have been proposed to assist a person in the carrying and delivery of mail and other articles. Some of the devices which have been proposed have been patented. For example, U.S. Pat. No. 5,088,634, which issued to T. MacLaren on Feb. 18, 1992, discloses a mailbag support harness for carrying a mailbag at waist level proximate to the front of a mail carrier's body. The harness includes an adjustable belt to secure the harness to the user, upright brackets rigidly mounted on opposite sides of the belt and on the side of the user's body, and a support strap between said brackets positioned against the back of the user. The mail support harness is intended to provide hands-free support for the weight of the mailbag about the mail carrier's center of gravity thereby facilitating the easier and more efficient delivery of mail.

U.S. Pat. No. 2,881,441, which issued to H. Bass on Apr. 14, 1959, discloses an improved ladies purse or arm bag. The inventive arm bag has a sleeve portion intended to be received over the forearm of the wearer and a bag portion attached to the bottom of the sleeve portion and hanging downwardly therefrom. The arm bag is equipped with multiple pockets and straps to store and carry various articles. By having the user wear the arm bag over his or her forearm, the invention reduces the risk of purse snatching, or of simply dropping one's purse.

U.S. Pat. No. 5,294,030, which issued to E. Jollivette on Mar. 15, 1994, discloses a waist supported carrying bag. The carrying bag resembles an oversized tool belt. The carrying bag comprises a pair of large open topped compartments on either side of the apparatus, a waist girdle and belt loops connected to the compartments to support the compartments, flaps covering the open tops of the compartments, belt loops connected to the girdle and compartments, and pockets inside the compartments. Optional suspenders, shoulder straps, and/or a vest may be attached to the belt for distributing the weight.

U.S. Pat. No. 4,836,428, which issued to R. Evans et al. on Jun. 6, 1989, discloses a mailbag structure adapted for carrying a heavy load, such as mail and the like, at the waist or to either side of the body. The bag includes a mail container resembling a rectangular basket with a belt adapted to attach to the container and releasably wrap around the waist of the user. A belt loop device is appended to the back wall of the container for removably attaching the belt to the exterior of the container back wall.

SUMMARY OF THE INVENTION

In accordance with the present invention, there is provided a novel arm pouch accessory which can be employed by a mail carrier in the delivery of mail. More specifically, the present invention discloses an arm pouch accessory which provides a mail carrier with a convenient transition area between the mailbag and mailbox for sorting and holding the incoming and outgoing mail. The arm pouch accessory comprises a support member having an inner panel and an outer panel defining an open sleeve configuration adapted to fit over the user's arm; a pouch formed on the exterior surface of the outer panel having an accessible opening therein; and a connector secured to a lower portion of the support member adapted to secure the support member to the user by attachment to a belt or other article of clothing worn by the user.

In a preferred embodiment, the support member further comprises a closure member secured to the exterior surface of the outer panel and adapted to fit over and close the opening in the pouch. The closure member is secured to the outer panel adjacent the opening in the pouch, whereby the closure member can alternatively fit over the opening in the pouch to close the pouch, or can fit into the opening of the pouch in a manner providing an unobstructed opening to the pouch. A first fastener is mounted to the closure member. A second fastener is mounted to the outside of the pouch and is adapted to mate with the first fastener thereby securing the closure member in a closed position. A third fastener is mounted to the outer panel of the support member adjacent to the pouch and is adapted to mate with the first fastener thereby securing the closure member in an open position. Acceptable fasteners would include, but would not be limited to, thistle cloth or Velcro (hook and pile pressure sensitive fastener) a button, hook, snap, or other fasteners.

Also in a preferred embodiment, the connector secured to the lower portion of the support member releasably secures the support member to the user by attachment to a belt or other article of clothing. The preferred connector comprises an outer downwardly-extending tab member and an inner downwardly-extending tab member adapted to securely mate around an article of clothing worn by the user. The preferred connector further comprises a fourth fastener mounted to the inner tab member and a fifth fastener mounted to the outer tab member. The fifth fastener is adapted to mate with the fourth fastener thereby securing said connector around a belt or other article of clothing worn by the user. Again, acceptable fasteners would include, but would not be limited to, thistle cloth or Velcro (hook and pile pressure sensitive fastener) a button, hook, snap, or other fasteners. Alternatively, the connector may comprise a loop-type coupler, such as a ring or cloth loop, adapted to fit around a belt worn by the user of the support member.

The arm pouch accessory is typically formed of a flexible porous fabric. The inner and outer panels are preferably formed by a continuous sheet of fabric which is turned back at the upper portion of the support member to form the sleeve opening and is fastened at the bottom of the support member along opposing edges of the fabric member.

In a further aspect of the present invention there is provided a method for assisting a mail carrier in the carrying, delivering, and exchanging of incoming and outgoing mail or other articles. This process or method comprises the steps of providing a support member having an inner panel and an outer panel defining an open sleeve configuration to fit over one of the user's arms and having a pouch formed on the outer surface of the outer panel which has an opening accessible to the user, a lower portion of the flexible support member being secured to the user by attachment to an article of clothing; maintaining the support member on the user's arm in a configuration in which the user's arm is displaced from the user's side to provide a basket configuration between the user's side and the inner panel of the support member; transferring an article for delivery from a separate accessible container to the basket configuration; and transferring the article from the basket container into an addressee's mailbox. In a preferred embodiment, the process further comprises a step prior to the transfer of an article to the mailbox of withdrawing from the mailbox an item of mail posted by the addressee and depositing the item of mail into the pouch on the outer panel of the support member.

BRIEF DESCRIPTION OF THE DRAWINGS

The invention can be more fully understood by referencing the accompanying drawings wherein.

DETAILED DESCRIPTION OF THE INVENTION

Figure 1:
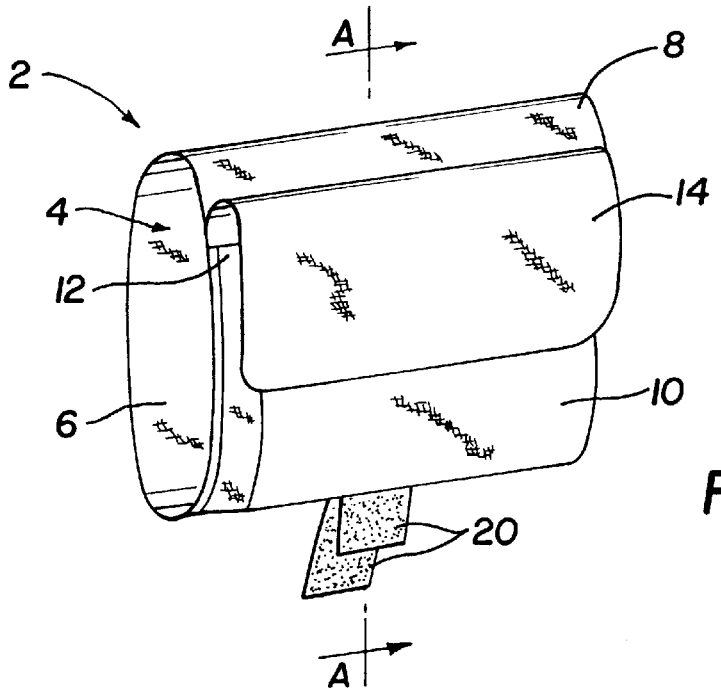
FIG. 1 is a perspective view of the preferred embodiment of the present invention with the pouch closed via the closure member.
Figure 2:
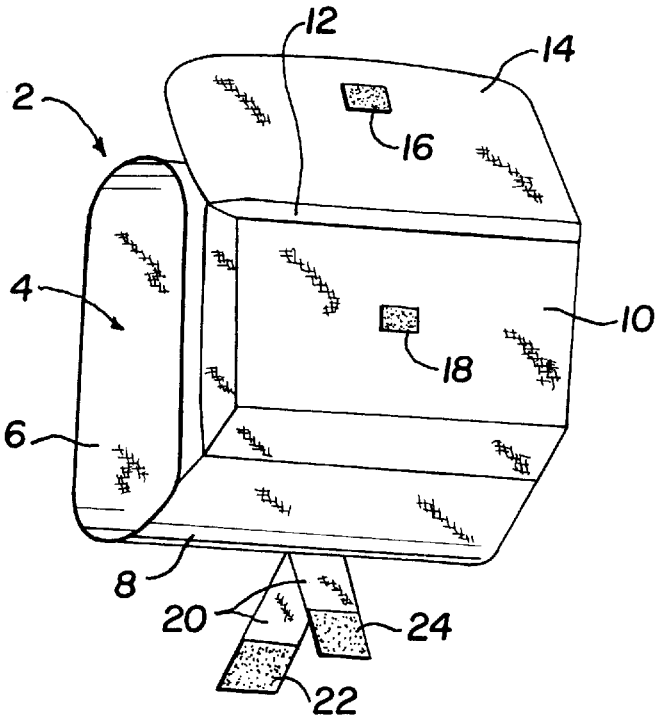
FIG. 2 is a perspective view of the preferred embodiment of the present invention with the pouch open.
Figure 3:
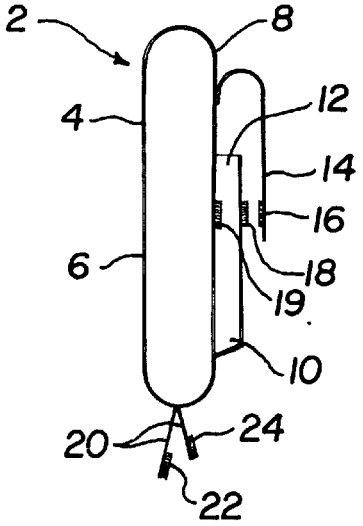
FIG. 3 is a sectional view of the preferred embodiment of the present invention upon the plane indicated by section line A—A of FIG. 1.

Referring now to the drawings, wherein like reference characters denote corresponding parts:

A preferred embodiment of the present invention is illustrated in FIGS. 1, 2, & 3. As shown in FIG. 1, the preferred embodiment of the arm pouch accessory 2 comprises a support member 4 having an inner panel 6 and an outer panel 8 which form an open sleeve or sling configuration which fits over the user's arm. On the exterior surface of outer panel 8 is formed a pouch 10 having an accessible opening 12 therein. A closure member 14 is secured to the exterior surface of outer panel 8 adjacent pouch 10 and is adapted to fit over pouch opening 12 to close pouch 10. As shown in FIG. 1, closure member 14 is in a closed position covering opening 12 of pouch 10. Secured to a lower portion of the support member 4 is a connector 20 adapted to secure the support member 4 and entire arm pouch accessory 2 to the user by attachment to an article of clothing.

The embodiment of FIG. 1 is configured for use by a mail carrier who will generally use one hand/arm to deposit and withdraw mail from a mailbox. The support member 4 fits over the user's other arm as a sleeve or sling, preferably oriented such that the pouch 10 is on the outer panel of the support member 4 away from the body of the user. For example, if the mail carrier uses his right hand to deposit and withdraw mail, the mail carrier will slide his left wrist and hand through the proximal end of the support member 4 until his hand and wrist project out the opposite, distal end of the support member 4, such that the arm pouch accessory 2 is supported on the left forearm of the user by the support member 4. Note that the proximal and distal ends have not been designated on the drawings because if the user wishes to use his opposite (in our example the left) arm, the proximal and distal end may be reversed to maintain the orientation of the accessory 2 with the pouch 10 on the outside.

Arm pouch accessory 2 is preferably constructed of a flexible, durable, and porous fabric. Support member 4 may be made from a continuous sheet of fabric which is turned back at the upper portion of the support member 4 to form a sleeve or sling which slides onto the arm of the user. The fabric accessory provides a layer of protection between the mail and perspiration from the user's arm, if any. On the bottom of support member 4 is a connector 20 which releasably attaches to the user's belt or belt loops. A pocket is formed between the interior panel 6 of the support member 4 and the body of the user. The user can open and close this pocket by moving his arm towards and away from his or her body. On the outer panel 8 of the support member 4 is a pouch 10 with an opening 12. In the preferred embodiment, closure member 14 is secured to the exterior surface of outer panel 8 of support member 4 adapted to fit over the opening 12 of pouch 10. This closure member 14 is formed to close the pouch 10 to protect mail or other articles contained therein from inclement weather, and is formed to stow neatly out of the way for normal use in good weather.

FIG. 2 is a perspective view of the preferred embodiment for the arm pouch accessory 2 with closure member 14 in an open position, exposing pouch opening 12 of pouch 10. A first fastener 16, shown of thistle cloth or Velcro, is mounted to closure member 14. A second fastener 18 is mounted to the exterior of pouch 10 and is adapted to mate with first fastener 16 thereby securing closure member 14 in a closed position. Preferably, a third fastener 19 is mounted on the outer panel 8 of support member 4 inside or adjacent to pouch 10 also adapted to mate with first fastener 16 for securely stowing the closure member 14 in an open position thereby leaving pouch 10 with an unobstructed opening 12 (third fastener 19 is shown in FIG. 3).

FIG. 2 shows the outer and inner downwardly-extending tab members of preferred connector 20. Connector 20 is adapted to secure around an article of clothing worn by the user, typically a belt or belt loop. A fourth fastener 22, also shown of thistle cloth or Velcro, is mounted to the inner tab member of connector 20. A fifth fastener 24 is mounted to the outer tab member of connector 20 and is adapted to mate with the fourth fastener 22 thereby securing connector 20 to an article of clothing worn by the user.

FIG. 3 is a sectional view of the preferred embodiment of the present invention upon the plane indicated by section line A—A of FIG. 1. FIG. 3 shows a cross section of the preferred arm pouch accessory 2 with the closure member 14 in a closed position over the opening of pouch 10. Support member 4 is shown having an inner panel 6 and an outer panel 8 which form an open sleeve or sling configuration. On the exterior surface of outer panel 8 is formed a pouch 10 having an accessible opening 12 therein. A closure member 14 is secured to the exterior surface of outer panel 8 adjacent pouch 10 and is adapted to fit over pouch opening 12 to close pouch 10. FIG. 3. also shows first fastener 16 mounted to preferred closure member 14 which alternatively mates with either second fastener 18 attached to the exterior of pouch 10 to secure closure member 14 in a closed position, or third fastener 19 attached to the outer panel 8 of support member 4 inside pouch 10 to secure closure member 14 in an open position. Secured to a lower portion of the support member 4 is the connector 20 adapted to secure the support member 4 and entire arm pouch accessory 2 to the user by attachment to an article of clothing. FIG. 3 shows the outer and inner downwardly-extending tab members of preferred connector 20 as well as the mating fourth fastener 22 and fifth fastener 24 mounted to the tab members of connector 20.

To use the arm pouch accessory 2 the user must first don the accessory by attaching the connector 20 on the bottom portion of support member 4 to an article of clothing, typically a belt or belt loop, and then slipping the support member 4 over the user's arm with the pouch 10 facing outward. The general method for using the arm pouch accessory 2 in the delivery of mail comprises: transferring an article for delivery from the mail carrier's mailbag, or other container, to the inside pocket configuration between the mail carrier's torso and the interior panel 6 of the support member 4; transferring an article for pick-up from the mailbox to the pouch 10 on the outer panel 8 of the support member 4; and transferring the article for delivery from the inside pocket configuration to the mailbox.

While the invention has been particularly shown and described with reference to a preferred embodiment, it is to be understood that various changes in form and detail may be made hereto without departing from the spirit and scope of the present invention.

What is claimed is:

1. An arm pouch accessory adapted to be worn by a mail carrier for use in delivering mail and other articles, comprising:

a support member having an inner panel and an outer panel defining an elongated open sleeve configuration extending from a proximal end of said support member to an opposed distal end of said support member defining a length therebetween and adapted to fit over a forearm of the carrier in a manner in which the carrier's hand and wrist of the forearm project out of the distal end of said support member;

a pouch formed on the exterior surface of said outer panel having an accessible opening therein and an opposing closed end defining a pouch depth therebetween which is substantially transverse to said length between said proximal and distal ends; and a connector secured to a lower portion of said support member, proximate said closed end of said pouch and extending away fron said opening adapted to secure said support member to the carrier by attachment to an article of clothing displaced from the arm of the carrier.

2. The accessory of claim 1 further comprising a transversely elongated closure member secured to the exterior surface of said outer panel of said support member, adapted to fit over and close a substantial portion of the opening in said pouch.

3. The accessory of claim 2 further comprising a first fastener mounted to said closure member.

4. The accessory of claim 3 further comprising a second fastener mounted to the exterior of said pouch adapted to mate with said first fastener mounted to said closure member, thereby securing said closure member in a closed position.

5. The accessory of claim 3 wherein said closure member is adapted to fit into the opening of said pouch in a manner providing an unobstructed opening.

6. The accessory of claim 5 further comprising a third fastener mounted to the outer panel of said support member adjacent said pouch adapted to mate with said first fastener mounted to said closure member, thereby securing said closure member in an open position.

7. The accessory of claim 4 wherein said first fastener and said second fastener comprise mating thistle cloth hook and pile fasteners.

8. The accessory of claim 6 wherein said first fastener and said third fastener comprise mating thistle cloth hook and pile fasteners.

9. The accessory of claim 1 wherein said connector at the bottom of said support member comprises a loop-type coupler adapted to fit around a belt worn by the carrier of the support member.

10. The accessory of claim 1 wherein said connector releasably secures said support member to the carrier by attachment to the article of clothing.

11. The accessory of claim 10 wherein said connector comprises an outer downwardly-extending tab member and an inner downwardly-extending tab member adapted to securely mate around the article of clothing worn by the carrier.

12. The accessory of claim 11 wherein said connector further comprises a fourth fastener mounted to said inner tab member, and a fifth fastener mounted to said outer tab member adapted to mate with said fourth fastener thereby securing said connector around the article of clothing worn by the carrier.

13. The accessory of claim 12 wherein said fourth fastener and said fifth fastener comprise mating thistle cloth hook and pile fasteners.

14. The accessory of claim 1 wherein said support member is formed of a flexible porous fabric.

15. The accessory of claim 1 wherein said inner and outer panels are defined by a continuous sheet of fabric which is turned back at the upper portion of said support member to form the sleeve configuration.

16. A process for assisting a mail carrier in the carrying, delivering, and exchanging of incoming and outgoing mail or other articles, comprising the steps of:

providing a support member having an inner panel and an outer panel defining an open sleeve configuration to fit over one of the carrier's arms and having a pouch formed on the outer surface of said outer panel which has an opening accessible to the carrier, a lower portion of said flexible support member being secured to the carrier by attachment to an article of clothing;

maintaining said support member on the carrier's arm in a configuration in which the carrier's arm is displaced from the user's side to provide a basket configuration between the user's side and the inner panel of said support member;

transferring an article for delivery from a separate accessible container to said basket configuration; and transferring said article from said basket configuration into an addressee's mailbox.

17. The process of claim 15 further comprising a step prior to the transfer of said article to said mailbox of withdrawing from a mailbox an item of mail posted by the addressee and depositing said item of mail into said pouch.

* * * * *